US006868578B1

(12) United States Patent
Kasper et al.

(10) Patent No.: US 6,868,578 B1
(45) Date of Patent: Mar. 22, 2005

(54) UPRIGHT VACUUM CLEANER WITH CYCLONIC SEPARATION

(75) Inventors: Gary A. Kasper, Grand Rapids, MI (US); Thomas K. Ankney, East Grand Rapids, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 294 days.

(21) Appl. No.: 10/038,568

(22) Filed: Jan. 3, 2002

Related U.S. Application Data

(60) Provisional application No. 60/261,875, filed on Jan. 11, 2001.

(51) Int. Cl.[7] ..... A47L 9/10; A47L 9/14; A47L 9/16

(52) U.S. Cl. ..... 15/347; 15/351; 55/337; 55/426; 55/459.1; 55/DIG. 2; 55/DIG. 3

(58) Field of Search ..... 15/344, 350, 351, 15/352, 353; 55/337, 372, 426, 429, 459.1, DIG. 2, DIG. 3

(56) References Cited

U.S. PATENT DOCUMENTS

| | | | | | |
|---|---|---|---|---|---|
| 2,542,634 | A | | 2/1951 | Davis et al. | |
| 5,935,279 | A | * | 8/1999 | Kilstrom | 55/337 |
| 6,070,291 | A | | 6/2000 | Bair et al. | |
| 6,146,434 | A | * | 11/2000 | Scalfani et al. | 55/334 |
| 6,195,835 | B1 | | 3/2001 | Song et al. | |
| 6,256,833 | B1 | | 7/2001 | Steinberg | |
| 2001/0052166 | A1 | | 12/2001 | Park et al. | |
| 2001/0054213 | A1 | | 12/2001 | Oh et al. | |

* cited by examiner

*Primary Examiner*—Terrence R. Till
(74) *Attorney, Agent, or Firm*—McGarry Bair PC

(57) ABSTRACT

An upright vacuum cleaner with a small cyclone separator is mounted on and in fluid communication with an elongated rigid tube that forms part of a working air conduit and also forms part of an upright handle that is pivotally mounted to a base module with a suction nozzle upstream from a conventional bag filter in a dirty air or clean air dust collection vacuum cleaner.

15 Claims, 10 Drawing Sheets

UPRIGHT VACUUM CLEANER WITH CYCLONIC SEPARATION

CROSS REFERENCE TO RELATED APPLICATIONS

This application claims the benefit of U.S. provisional application Ser. No. 60/261,875, filed Jan. 11, 2001.

BACKGROUND OF THE INVENTION

1. Field of the Invention

This invention relates to upright vacuum cleaners and, more particularly, to upright vacuum cleaners incorporating a cyclone separator in a filter bag-type system.

2. State of the Prior Art

Upright vacuum cleaners include a handle mounted to a base and pivotable between an inclined use position and a generally vertical storage position. Such an upright vacuum cleaner is disclosed in commonly owned U.S. patent application Ser. No. 09/487,407, filed Jan. 19, 2000, now U.S. Pat. No. 6,256,833 issued Jul. 10, 2001. The disclosed upright vacuum cleaner includes a suction nozzle in the base and an agitation brush in the suction nozzle, the suction nozzle being fluidly connected to a suction source and a filter bag enclosure mounted to the handle of the cleaner. Soil from a surface being cleaned is entrained in an airflow from the suction nozzle and transported to the filter bag enclosure for deposit in a semi-permeable filter bag, as is well known in the art. A filter bag is generally disposable, and requires frequent replacement when it becomes fill. The effectiveness of some vacuum cleaners decreases prior to the filter bag becoming full, as fine particles trapped by the filter bag degrade its permeability and cause a loss of suction deliverable to the suction nozzle.

Vacuum cleaners using a cyclone separator are known in the art, and have the advantage of not requiring replacement of the disposable, non-reusable, filter bag. However, in order to match the dirt capacity of a filter bag-type vacuum cleaner, the cyclone-type vacuum cleaner must be larger to accommodate the generally cylindrical cyclone separation chamber. A side effect of increasing the diameter of the cyclone chamber is a decrease in the available efficiency of dirt separation; the power available to the vacuum cleaner can generate a finite airflow, and as the cyclone chamber increases in size, that finite airflow results in a lower velocity within the cyclone chamber. This lower velocity adversely affects the efficiency of the cyclone separator. The large dirt reservoir is also cumbersome to handle while still requiring frequent emptying to avoid re-entrainment of collected dirt into the suction airstream. Decreasing the size of the cyclone chamber could increase its efficiency and ease of handling, but at the cost of further decreasing its capacity to hold dirt when compared to the filter bag-type cleaner.

U.S. Pat. No. 6,146,434 issued Nov. 14, 2000, to Scalfani et al. discloses a stick vacuum cleaner having a cyclonic dirt cup assembly and a filter element in the suction plenum of the suction motor. The "stick" vacuum disclosed is limited by weight in the strength of suction motor it can accommodate. Further, the lesser efficiency of a larger cyclone, combined with a large, undifferentiated exhaust opening from the cyclone directly into the filter element, will lead to rapid degradation of filter permeability, and will require frequent replacement of the filter element.

It would be advantageous to provide a vacuum cleaner incorporating the advantage of an efficient cyclone separator that is easy to empty and restricts passage of dirt particles in a working airflow, with the supplemental filtering and dirt-carrying capacity of a filter bag.

SUMMARY OF THE INVENTION

The invention relates to an upright vacuum cleaner having a base module and a handle pivotally mounted thereto for pivotal movement about a pivot axis between an upright stored position and a reclining use position has the base module having a suction nozzle, a filter bag removably mounted to the handle for movement therewith, a working air conduit between the suction nozzle and the filter bag and a suction source mounted to one of a lower portion of the handle and the base module and in communication with the suction nozzle and the filter bag for moving dust-laden air between the suction nozzle and through the filter bag. According to the invention, a cyclonic dust separator is mounted in the working air conduit upstream of the filter bag for separating larger particles from the dust-laden air before the dust-laden air passes through the filter bag.

Preferably, the working air conduit is formed in part by a rigid elongated tube that forms a portion of the handle and that extends between the base module at a lower end and the filter bag at an upper end.

The cyclonic dust separator preferably includes a cyclone body having an inlet opening and an outlet opening wherein at least the inlet opening is connected to the rigid elongated tube upstream from the outlet opening. In a preferred embodiment of the invention, the outlet opening of the cyclone body is also connected to the rigid elongated tube and the cyclonic separator is connected to the rigid elongated tube intermediate the ends thereof. The cyclone body is adapted to produce a cyclonic air current for separating dirt contained in working air entering the cyclone body through the inlet opening. A dirt-collecting tub is removably mounted to the cyclone body for collecting dirt separated from the dust-laden air by the cyclonic air current of the cyclone body. The cyclonic dust separator separates larger dust particles and debris from the dust-laden air before the duet-laden air is filtered by the bag filter.

In one embodiment, the cyclone body further comprises a dirt-separating grille having a plurality of holes between said inlet and outlet openings. Typically, the dirt-separating grille is cylindrical and is axially positioned in the dirt-collecting tub. Further, an annular baffle plate is mounted to a bottom portion of the dirt-separating grille and extends laterally thereof. Preferably, the annular baffle plate is frusto-conical in shape. The dirt-collecting tub is preferably removably suspended from the cyclone body by at least one latch.

The filter bag is typically a conventional filter bag that is mounted in a soft porous bag that is removably mounted to an upper portion of the elongated tube. The soft porous bag is mounted to the handle.

In one embodiment, the suction source is mounted in the working air conduit between the suction nozzle and the cyclonic dust separator. In another embodiment, the suction source is mounted in the working air conduit downstream of the filter bag.

In yet another embodiment, the suction source is mounted in the working air conduit between the cyclonic dust separator and the filter bag.

DETAILED DESCRIPTION OF THE PREFERRED EMBODIMENTS

Figure 1:
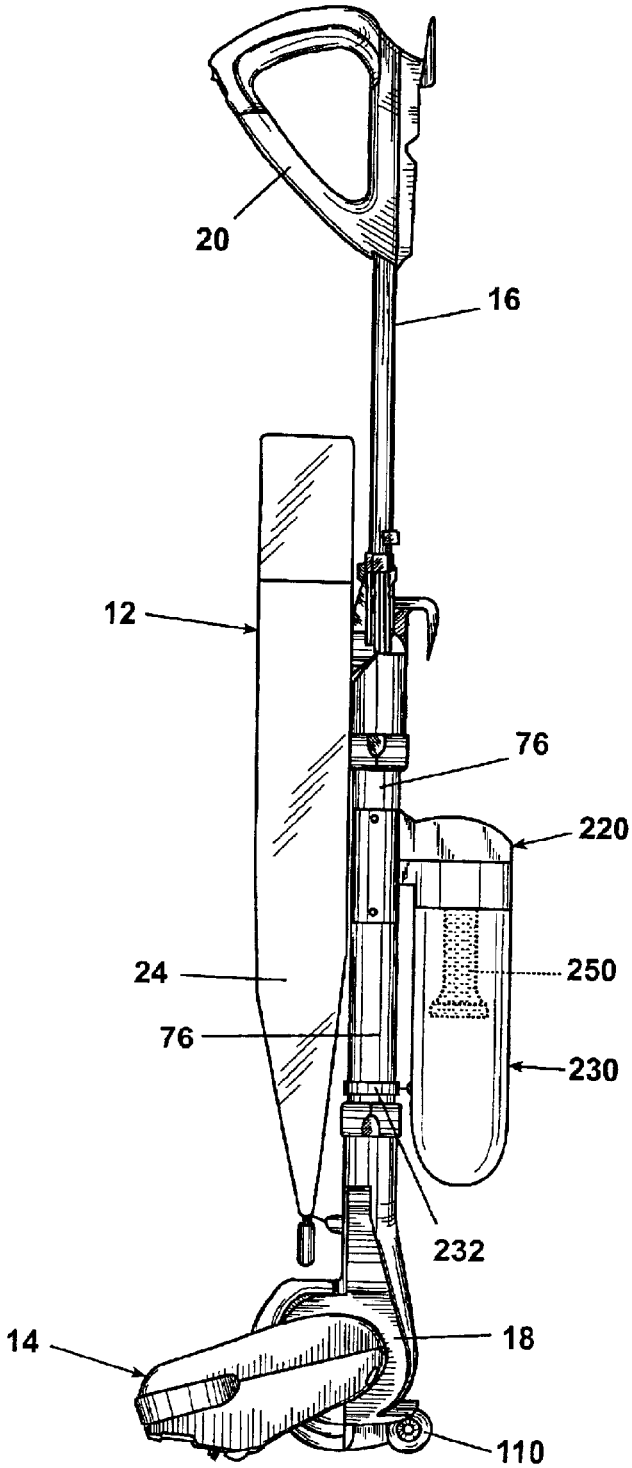
FIG. 1 is a side view of an upright vacuum cleaner with a cyclone separator according to the invention.

Referring to the drawings, and to FIG. 1 in particular, an upright vacuum cleaner 10 according to the invention comprises a handle assembly 12 pivotally mounted to a base module 14 carried in part by a wheel assembly 110. Handle assembly 12 includes an upper end 16 and a lower end 18. Upper end 16 comprises a hand grip 20. Handle assembly 12 is pivotally mounted to base module 14 at lower end 18, lower end 18 also preferably housing a suction source fluidly connected to base module 14 for applying suction to a surface being cleaned, and further fluidly connected to a collection bag 24 carried by handle assembly 12. Base module 14 also houses an agitation brush in a suction opening applied to the surface being cleaned, commonly driven by the suction source. A working air conduit (not shown) extends between the suction opening and the suction source. Handle assembly 12 further comprises a tubular member 76 for fluidly connecting the suction source to the collection bag 24. The collection bag is a conventional soft bag filter in which a soft porous bag is mounted to the handle and houses a removable porous bag filter. The removable bag filter is in communication with an open upper end of the tubular member 76. The general form of the upright vacuum cleaner 10 is described in part in U.S. Pat. No. 6,256,833 issued Jul. 10, 2001, which is incorporated herein by reference in its entirety.

Figure 3:
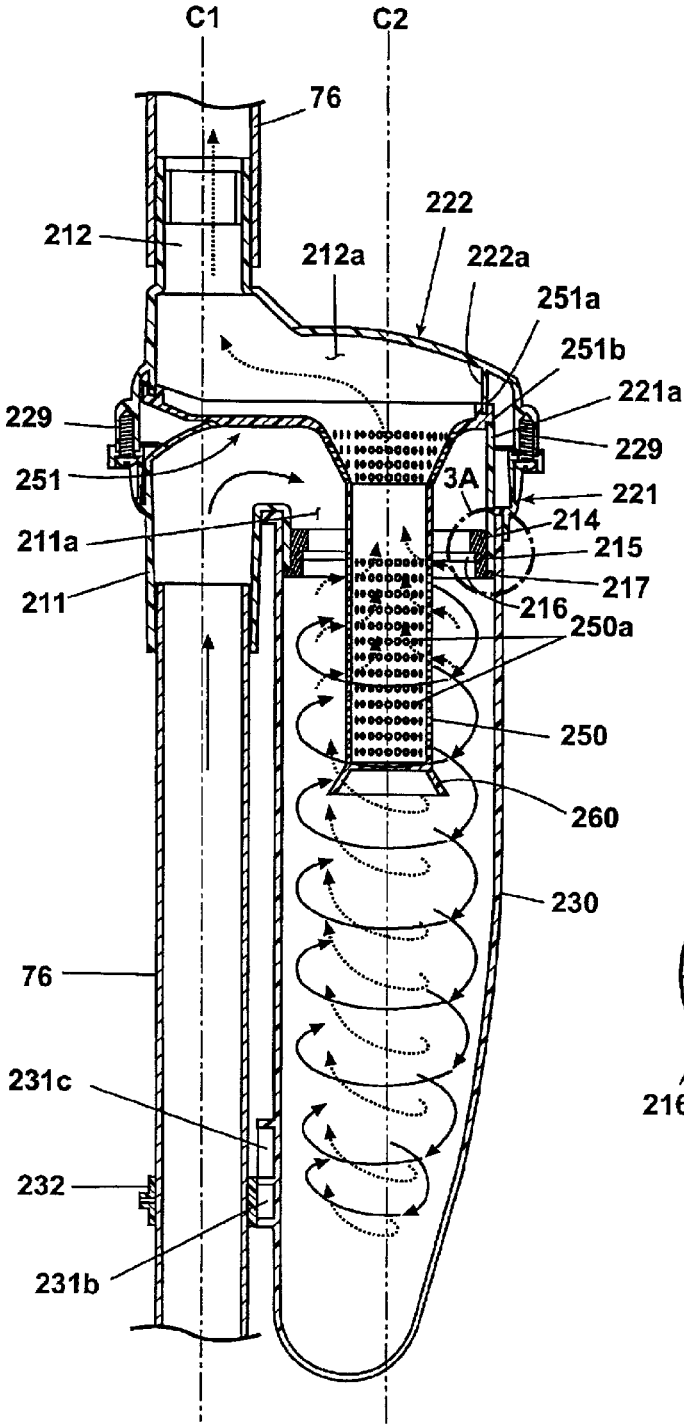
FIG. 3 is a cross-sectional view of the cyclone separator of FIGS. 1 and 2.

According to one embodiment of the invention, tubular member 76 includes upper and lower portions connected by a cyclone body 220 of a cyclone separator 210. The cyclone separator 210 is thus fluidly interposed in the tubular member 76, which forms a part of the worling air conduit, between the base module 14 and the collection bag 24. Cyclone body 220 diverts the fluid flow from the lower portion of tubular member 76, through cyclone separator 210, to the upper portion of tubular member 76, as illustrated in FIG. 3

Referring now to FIGS. 2–7, cyclone separator 210 includes a cyclone body 220 having first and second connecting tubes 211, 212 which are respectively connected to lower and upper portions of tubular member 76, a dirt-collecting tub 230 adapted to removably mount to the cyclone body 220, and a locking unit 240 which removably suspends the dirt-collecting tub 230 from the cyclone body 220.

The first and second connecting tubes 211 and 212 of the cyclone body 220 are formed to be offset from the center of the cyclone body 220. With this construction, if the cyclone separator 210 is connected to the tubular member 76 of the cleaner, the center of the cyclone separator, more concretely, the central axis of the dirt-collecting tub 230 is not placed on the axis C1 of the tubular member 76 but is placed in a different axis C2, as shown in FIG. 3. Thus, there is no need to separate the tubular member 76 of the cleaner in order to remove the dirt-collecting tub 230 to discard the dirt collected therein.

The cyclone body 220 is divided into a lower body unit 221 which is united to the first connecting tube 211 and an upper body unit 222 which is united to the second connecting tube 212 and the upper and lower body units 222 and 221 are combined each to the other by a plurality of screws 229.

An air inlet 211*a* communicating with the first connecting tube 211 is formed at the lower body unit 221 and an air outlet 212*a* communicating with the second connecting tube 212 is formed at the upper body unit 222. Here, the air inlet 211*a* and the air outlet 212*a* are formed by dividing the insides of the upper and lower body units 222 and 221 by curve ribs 222*a* and 221*a*, respectively. In addition, several pairs of fixing bosses 222*b* and 221*b* each having a screw hole at a predetermined position are formed to face each other at the upper and lower body units 222 and 221. A positioning aperture 211*b* and a resiliently mounted detent 212*b* for connecting the cyclone separator to the tubular member 76 are formed at the first and second connecting tubes 211 and 212, respectively, and a resiliently mounted detent 203'*b* and a positioning aperture 203"*b* which correspond to the positioning aperture 211*b* and the resiliently mounted detent 212*b* are formed at the lower and upper portions of tubular member 76, respectively.

The first connecting tube 211 is connected to the tubular member 76 nearer the base module 14 of the cleaner 10, and the second connecting tube 212 is connected to the tubular member 76 nearer the collection bag 24 of the cleaner 10. The dirty air drawn into the suction nozzle of the cleaner 10 and forced through tubular member 76 flows into the air inlet 211*a* of the first connecting tube 211 and in an oblique direction against the cyclone body 220, so that the whirlpool air current, shown as an arrow indicated by a solid line in FIG. 3, is generated inside of the cyclone body 220 and the dirt-collecting tub 230. By such a whirlpool air current, the debris contained in the air are separated from the air and fall to the bottom of tub 230 while the air is exhausted to the collection bag 24 of the cleaner 10 via the air outlet 212*a* of the cyclone body 220 and the upper tubular member 76, shown as an arrow indicated by a dotted line in FIG. 3.

Figure 2:
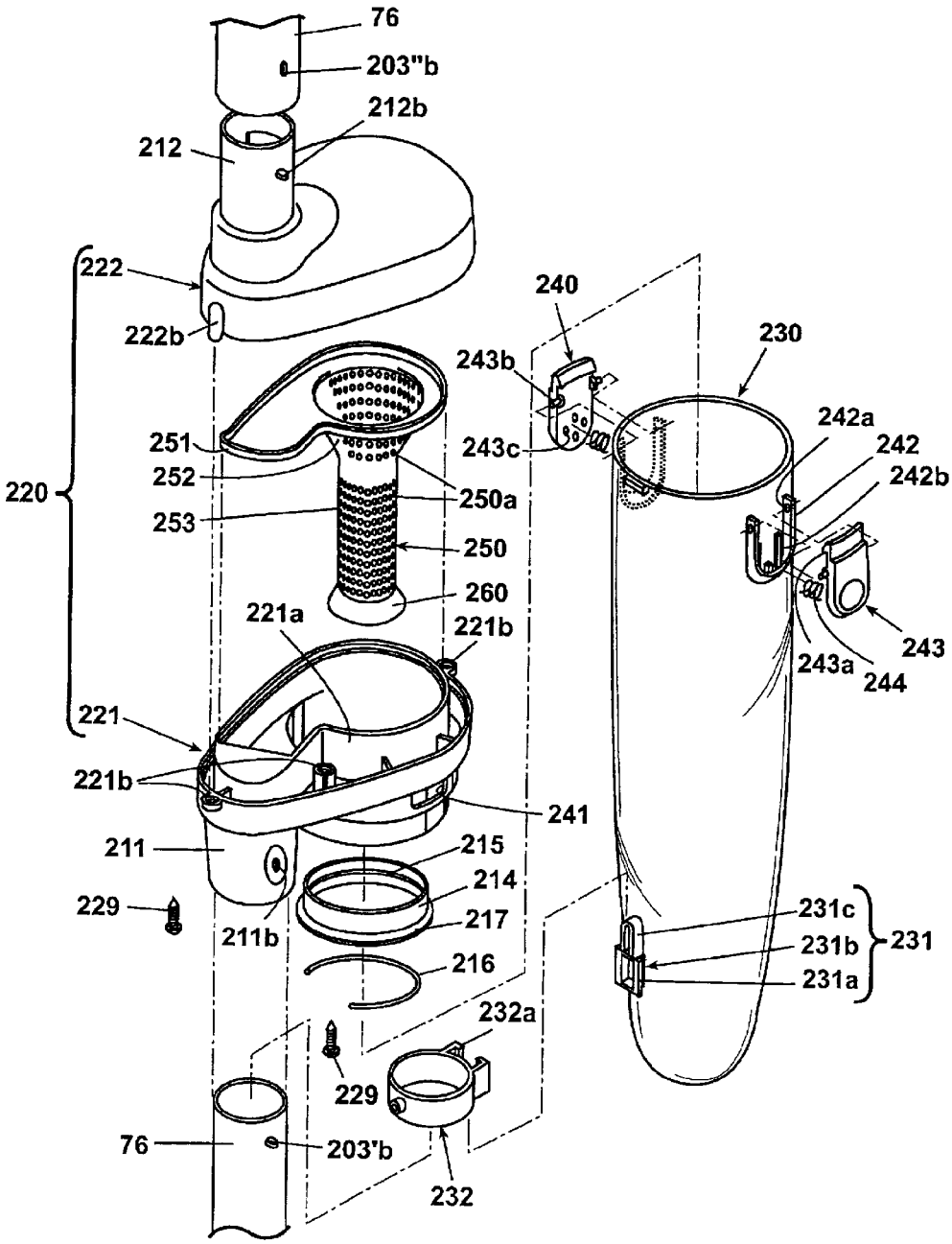
FIG. 2 is an exploded perspective view of the cyclone separator of FIG. 1.

As is best shown in FIG. 2, the dirt-collecting tub 230 is removably attached to the cyclone body 220 by the locking units 240. Tub 230 serves to form the whirlpool air current together with the cyclone body 220 and to collect the dirt separated from the air with the centrifugal force by the whirlpool air current.

The dirt-collecting tub 230 is generally formed to be a cylinder shape, but the shape thereof may be varied. But, in consideration of the external appearance, it may be formed to be a tapering cylinder in which the diameter of the lower portion is smaller than that of the upper portion.

Further, in order to easily check the dirt collected inside of the dirt-collecting tub 230 from the outside, it is preferable that the dirt-collecting tub 230 is made of transparent or translucent material, but this is not intended to limit the material of construction of the dirt-collecting tub 230. Also, it is preferable that the dirt-collecting tub 230 is made of material which is lightweight and tough for ready handling and so that it cannot be easily broken from impact or by dropping.

A supporting unit 231 for supporting the dirt-collecting tub 230 against the tubular member 76 of the cleaner is formed integrally at an inner side of the circumference of the lower portion of the dirt-collecting tub 230. The supporting unit 231 is inserted to a slide groove 232*a* of a fixing ring 232 placed over the tubular member 76. The supporting unit 231 includes a fixing projection 231*b* having a suspension jaw 231*a* which is fixed by being inserted to the slide groove 232*a* of the fixing ring 232, and a guide projection 231*c* which is formed in front of the fixing projection 231*b* to guide the insertion of the fixing projection 231*b* to the slide groove 232*a*. The guide projection 231*c* is tapered to ease alignment of the fixing projection 231*b* to the slide groove 232*a*. Fixing ring 232 can be fixed to the tubular member 76 by a screw (not shown) or can be integrally formed with the tubular member 76.

The locking unit 240 includes a pair of suspension holes 241 formed to face each other at both sides of the lower body unit 221, a pair of latches or lockers 243 which are hingedly connected to a pair of locker supporting units 242 formed at both sides of the upper portion of the dirt-collecting tub 230. Each locker 243 includes a hook portion 243*a* adapted to catch in a respective suspension hole 241. A spring 244 is positioned underneath each locker 243, on an opposite side of a hinge from hook portion 243*a*, to bias hook portion inwardly 243*a* toward suspension hole 241. Spring 244 pushes against tub 230 to bias hook portion 243*a* inwardly.

The locker supporting unit 242 is generally formed to be of U shape, a pair of hinge holes 242*a* and a spring supporting projection 242*b* are formed at predetermined positions, respectively. The locker 243 is placed to be rotated by a predetermined angle around the hinge projection 243*b* by the insertion of a pair of hinge projections 243*b* to the hinge holes 242*a* of the locker supporting unit 242.

A spring supporting projection 243*c* for supporting the spring 244 is formed at the inner surface of the locker 243. Here, the spring 244 elastically supports the locker 243 in the direction which the hook 243*a* is hooked in the suspension hole 241. Thus, if the dirt-collecting tub 230 is inserted to the lower body unit 221 of the cyclone body 220, the hook 243*a* of the locker 243 deflects until it aligns with and is inserted in the suspension hole 241 to connect dirt-collecting tub 230 to the cyclone body 220. The dirt-collecting tub 230 can be separated from the cyclone body 220 by pushing in on both lockers 243. Hooks 243*a* of the lockers 243 are released from each suspension hole 241 of the lower body unit 221. The tub 230 can then be lowered so that the supporting unit 231 at the lower portion of the dirt-collecting tub 230 is released from the fixing ring 232 of the tubular member 76. Tub 230 can thereby be conveniently separated from the cyclone body 220 and the dirt collected inside of the dirt-collecting tub 230 can be discarded.

Figure 3A:
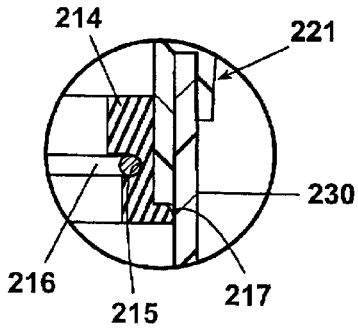
FIG. 3A is an enlarged cross-sectional view of a sealing gasket for the cyclone separator of FIGS. 1–3.

Referring to FIGS. 3 and 3A, a gasket 214 is provided inside air inlet 211*a* with a sealing edge 217 extending radially outwardly to engage the inner surface of tub 230. The gasket 214 serves to seal the tub 230 to prevent dust from escaping during operation of the vacuum cleaner. The gasket 214 is generally cylindrical and is formed with a circumferential groove 215 on its inner surface. The groove 215 is adapted to receive a spring ring 216. With the gasket in place in air inlet 211*a*, the spring ring 216 can be inserted into the groove 215 and is sized to exert an outward force on gasket 214. This outward force exerted by spring ring 216 on gasket 214 creates sufficient friction between gasket 214 and lower body unit 221 to prevent gasket 214 from being dislodged during removal of tub 230 from cyclone body 220.

Referring again to FIGS. 2–3, a dirt-separating grille 250 is attached to the cyclone body 220. The dirt-separating grille 250 serves to prevent the dust from flowing backward together with the air via the air outlet 212*a* of the cyclone body 220 when the cyclone separator 210 is operated. The dirt-separating grille 250 is placed to be downwardly extended from the air outlet 212*a* and has a plurality of minute holes 250*a*, so that the air circulating through the tub 230 must change direction before it is exhausted from the air outlet 212*a*, thereby stripping the dirt particles from the air due to the momentum of the particles. Typically, the cyclonic action of the air in the tub 230 is sufficient to separate particles smaller than the holes 250 from the air. The separated dirt particles thus fall into the lower portion of the dirt-collecting tub 230.

The dirt-separating grille 250 has a grille guide unit 251 formed at the upper portion, a conical grille unit 252 the inside of which is hollow, and a cylindrical grille unit 253, the lower portion of which is closed. These portions of the grille 250 are sealed together. The minute passing holes 250*a* are formed throughout the portions of the grille 250 except at a predetermined portion of the conical shape grille unit 252 and at the whole circumference of the cylinder shape grille unit 253 (i.e. an upper portion) near the air inlet 211*a*.

The grille guide unit 251 is supported by the curve ribs 222*a* and 221*a* formed at the upper and lower body units 222 and 221, to place the dirt-separating grille 250. A rib groove 251*a* for receiving the curve rib 222*a* of the upper body unit 222 is formed at the edge of the upper surface of the grille guide unit 251 and an end jaw unit 251*b* to which the curve rib 221*a* of the lower body unit 221 is closely mounted is formed at the other surface thereof.

In addition, a frustro-conical dirt-blocking plate 260 is mounted to a lower end of the grille 250 and extends outwardly thereof. The dirt-blocking plate 260 serves to block dirt from rising together with the air before the dirt reaches the dirt-separating grille 250, causing the dirt to fall again. Accordingly, debris cannot completely rise to the upper portion of the cyclone body 220 but is blocked to fall again, so that it is possible to remarkably reduce the quantity of the dirt reaching the minute passing holes 250*a* of the dirt-separating grille 250, and it is also possible to prevent debris from blocking the minute passing holes 250*a* of the dirt-separating grille 250.

Hereinafter, a description will be made on the operation of the vacuum cleaner 10 having the cyclone separator 210 as described above. With electric power supplied, the suctioning force is produced by the driving of the suction source of the cleaner 10. Then, the dirt enters the inside of the cyclone separator via the suction opening and the first connecting tube 211 together with the suction air, as shown in FIG. 3. In this case, the air which enters the cyclone separator flows in a slanting direction against the cyclone body 220 by the air inlet 211*a* of the first connecting tube 211.

Accordingly, the air produces a cyclonic air current and is directed to the lower portion of the dirt-collecting tub 230. In this process, debris contained in the air is separated from the air by the centrifugal force and descends along the inner side wall of the dirt-collecting tub to be collected at the dirt-collecting tub 230. And the air reverses and rises from the lower portions of the dirt-collecting tub 230 and is exhausted to the collection bag 24 of the cleaner 10 via the air outlet 212*a* and the second connecting tube 212, as the rising air current is rotated with a smaller radius. In this-case, any dirt rising together with the air does not pass through the holes 250*a* of the dirt-separating grille 250 and is collected at the dirt-collecting tub 230.

The dust-collecting process performed in the collection bag 24 is well known in the art. As the dirt-collecting tub 230 is filled with the dirt which has been separated from the airflow, the collected dirt is removed by separating only the dirt-collecting tub 230 from the cyclone body 220 without separating the cyclone separator from the extension pipe. This dirt is thus prevented from reaching the collection bag 24. By greatly decreasing the quantity of dirt that reaches the filter bag, the life of the filter bag is substantially increased, reducing the frequency of emptying and replacing the filter bag. The dirt in tub 230 is easy to observe, and tub 230 can be easily removed and emptied by the user without creating the cloud of dust so familiar to the user who has replaced filter bags.

Figure 4:
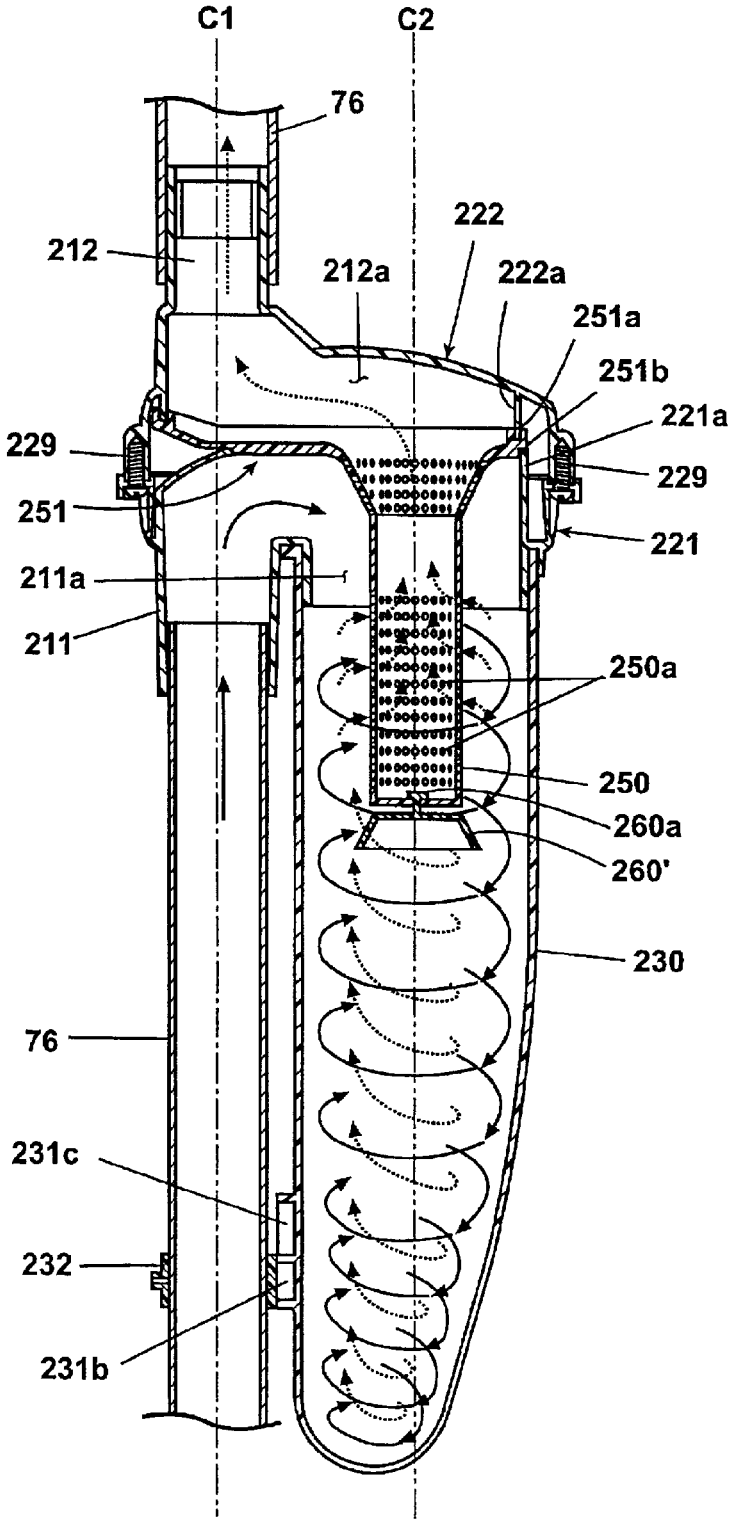
FIG. 4 is a cross-sectional view of a second embodiment of the cyclone separator of FIGS. 1–3.

FIGS. 3–7 illustrate multiple embodiments of the cyclone separator 210, wherein like reference numerals will be used to designate like or equivalent elements having the same function in each embodiment. FIG. 4 is a cross-sectional view illustrating the dust-collecting operation of a second embodiment of the cyclone separator 210. The basic construction of the cyclone separator 210 according to this embodiment of the invention is the same as that according to the embodiment of FIGS. 2–3 except that the construction of the dirt-blocking unit 260 at the lower portion of the dirt-separating grille 250 is somewhat different. In this embodiment, an additional dirt-blocking unit 260' is separated from the bottom of the grille 250 and is mounted for rotation by the cyclonically circulating air.

The dirt-blocking plate 260' is rotated by the whirlpool air current produced inside of the dirt-collecting tub 230, thereby effectively downwardly directing dirt which comes into contact with the dirt-blocking rotation plate 260'. Here, the dirt-blocking rotation plate 260' is of a frustro-conical shape. The protrusion 260*a* formed at the center of the upper portion of the dirt-blocking rotation plate 260' is mounted in an axial hole formed at the center of the lower portion of the dirt-separating grille 250 for rotation about a central axis of the grill. Other elements shown and the operation of the embodiment of FIG. 4 are the same as those of the first preferred embodiment of the present invention.

Figure 5:
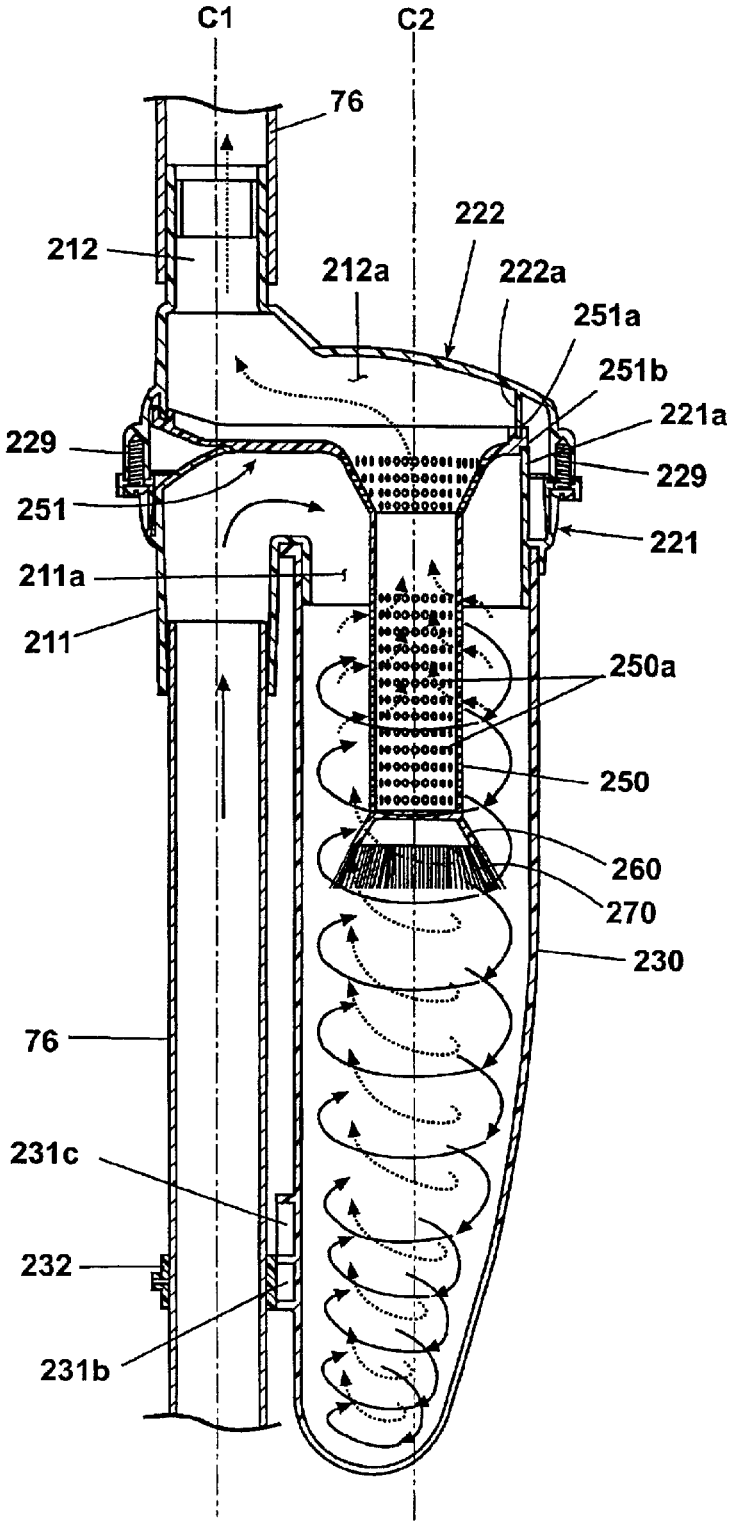
FIG. 5 is a cross-sectional view of a third embodiment of the cyclone separator of FIGS. 1–3.

FIG. 5 is an cross-sectional view showing a cyclone separator 210 according to a third embodiment of the present invention. The cyclone separator 210 according to this embodiment has a supplement blocking member 270 for supplementing the operation of the dirt-blocking plate 260. The supplement blocking member 270 may be formed of brush and is placed along the edge of the lower end of the dirt-blocking plate 260. In this case, the supplement blocking member 270 is placed to be widely distributed while maintaining the same angle as the dirt-blocking plate 260. Accordingly, it is possible to more effectively block dirt rising together with the air in the dirt-collecting tub 230. Other elements and operation are the same as those of the first and second preferred embodiments of the present invention and the detailed description thereof will be omitted.

Figure 6:
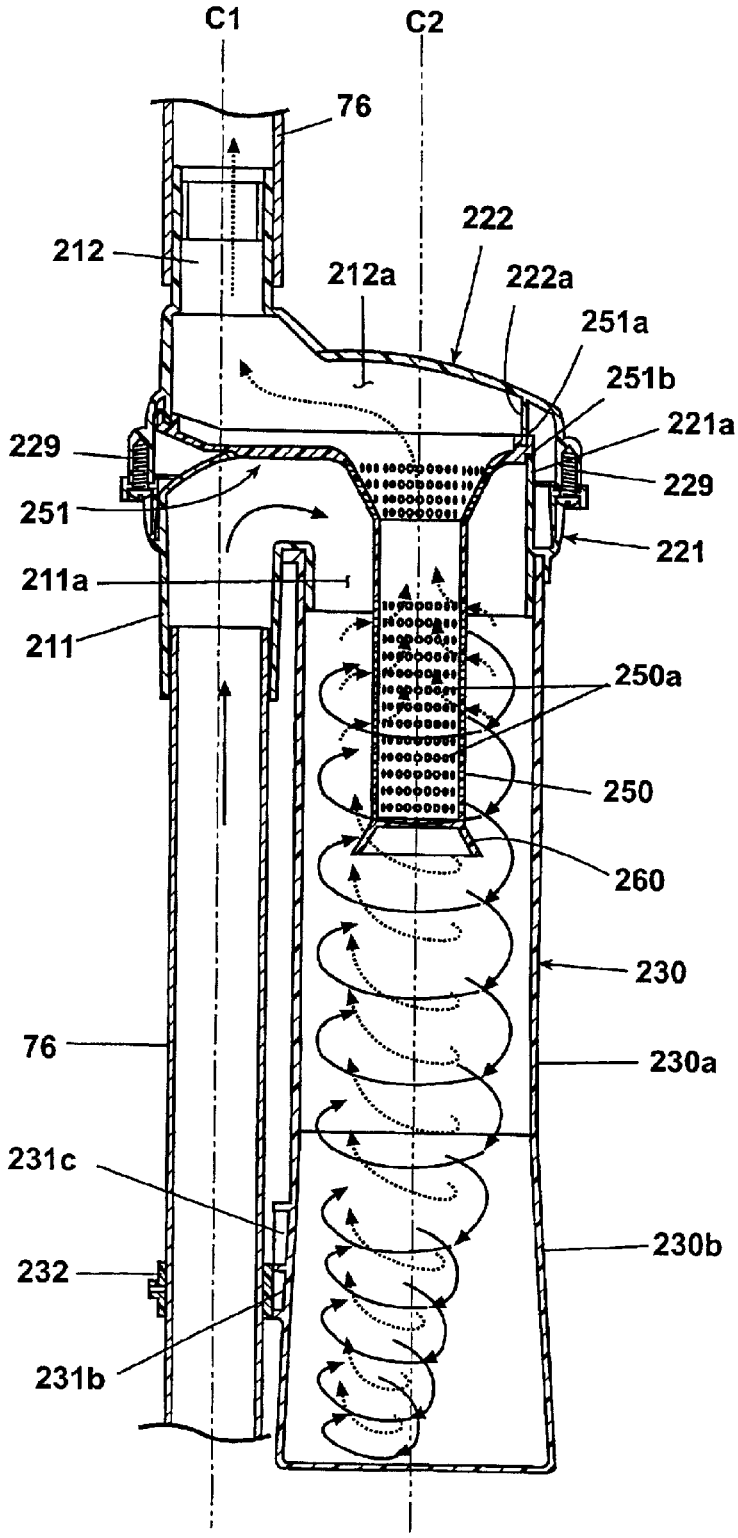
FIG. 6 is a cross-sectional view of a fourth embodiment of the cyclone separator of FIGS. 1–3.
Figure 7:
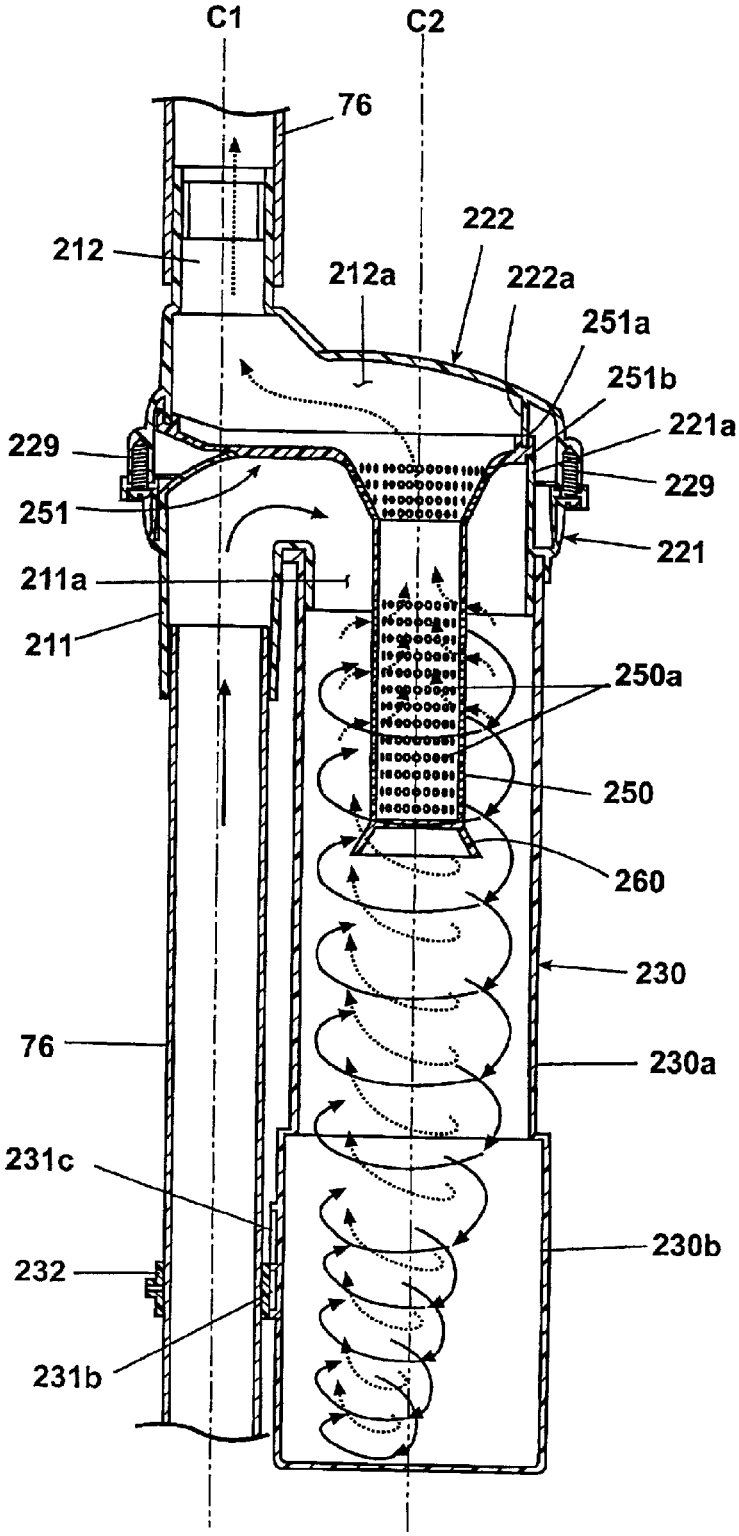
FIG. 7 is a cross-sectional view of a fifth embodiment of the cyclone separator of FIGS. 1–3.

FIGS. 6–7 are cross-sectional views of cyclone separators 210 according to fourth and fifth embodiments of the present invention. The basic construction of the cyclone separator according to these embodiments of the present invention is the same as that according to the first preferred embodiment of the present invention except that the dirt-collecting tub 230 is composed of a first cylinder unit 230*a* with a predetermined diameter which is formed at the upper portion thereof and a second cylinder unit 230*b* which is formed at the lower portion thereof and has a greater diameter than the first cylinder unit 230*a*.

Accordingly, the whirlpool air current produced in the dirt-collecting tub 230 rotates at a comparatively high speed in the first cylinder unit 230*a* and rotates at a relatively slow speed in the second cylinder unit 230*b*. Thus, it is possible to minimize the quantity of the dirt which rises from the bottom of the second cylinder unit 230*b* with the whirlpool air current.

Here, the second cylinder unit 230*b* may be formed to be a frustro-conical shape in which the diameter of the upper portion is smaller than that of the lower portion, as shown in FIG. 6, or to be a simple cylindrical shape, the diameter of which is greater than that of the first cylinder unit 230*a*, as shown in FIG. 7. Other construction elements and the operating effect are the same as those of the first and second preferred embodiments of the present invention and the detailed description thereof will be omitted.

Figure 8:
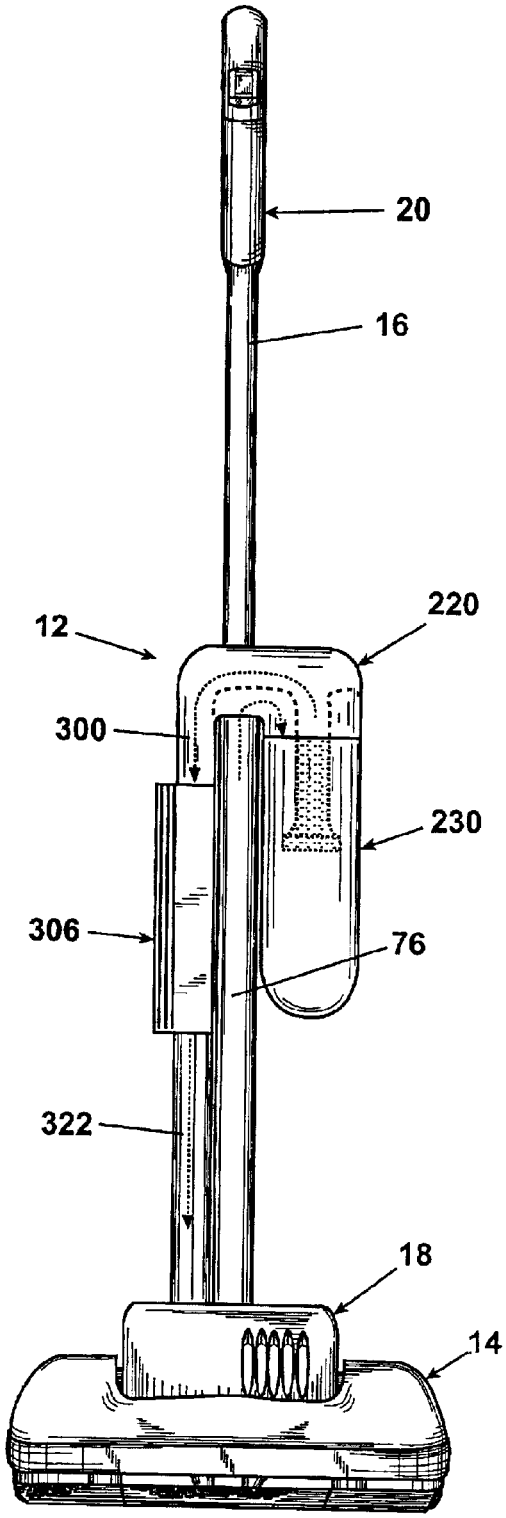
FIG. 8 is a front view of a sixth embodiment of an upright vacuum cleaner with cyclone separator according to the invention.
Figure 9:
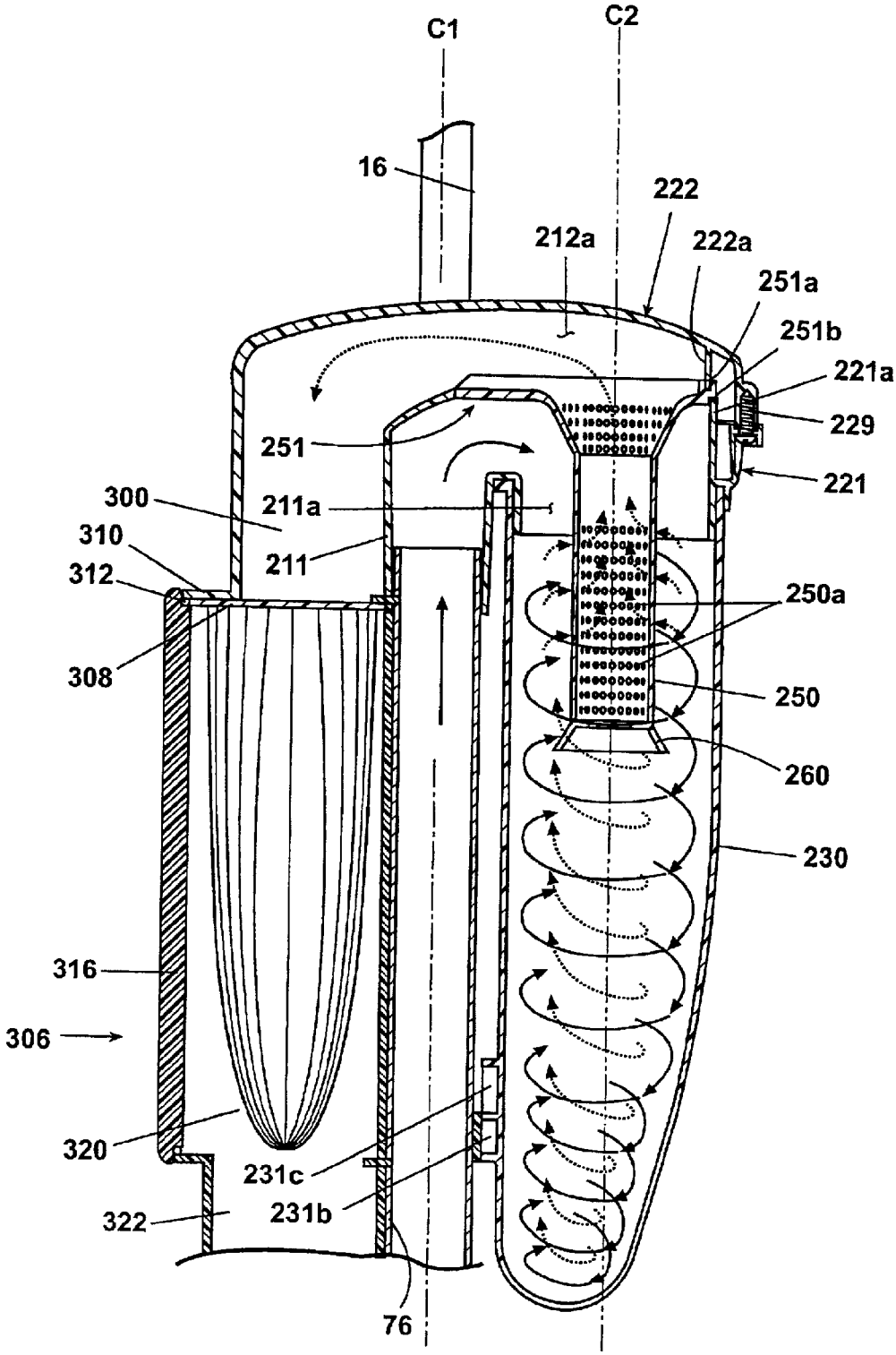
FIG. 9 is a cross-sectional view of a cyclone separator and filter assembly of the vacuum cleaner of FIG. 8.

Referring now to FIGS. 8–9, a sixth embodiment of the upright vacuum cleaner is disclosed wherein the suction source is on the clean air side of the filter rather than the dirty side as described above. In FIGS. 8–9, the tubular member 76 is fluidly connected to the suction nozzle of the base housing 14 and to the inlet of the cyclone separator 210. A second air conduit 300 fluidly connects the air outlet 212*a* of the cyclone separator 210 with a filter assembly 306. A third air conduit 322 fluidly connects the filter assembly 306 to the suction source located in the lower end 18 of the handle assembly 12. The suction source is thus protected from dirt particles and dust contained in the suction airflow stream as a majority of particles are collected in the cyclone separator 210 with finer particles collected by the filter assembly 306.

The filter assembly 306 comprises a socket 310 opening into assembly 306. An upper portion of socket 310 is adapted to hold a filter frame 308 in a sealing fashion to second air conduit portion 300. Filter frame 308 mounts filter medium 320 within assembly 306 in such a fashion that airflow from conduit portion 300 must pass through the filter medium 320 to reach third air conduit portion 322. Filter medium 320 can comprise a disposable filter bag or a series of disposable or reusable filter elements. Filter medium 320 will prevent dirt or dust particles that were not trapped by the cyclone separator 210 from passing to the suction source. When the filter medium 320 is a filter bag, it preferrably has an open mouth fluidly and sealingly connected to second air conduit portion 300 at filter frame 308, so that the air must pass through the bottom and sides of the filter bag, and dust is collected within the receptacle formed by the bag.

Filter frame 308 is secured in place within assembly 306 by a filter assembly cover 316. Assembly cover 316 cooperates with a seal 312 to cover socket 310 in an airtight fashion. As the suction source draws a vacuum in third air conduit portion 322, there is thus no loss of suction through socket 310.

Figure 10:
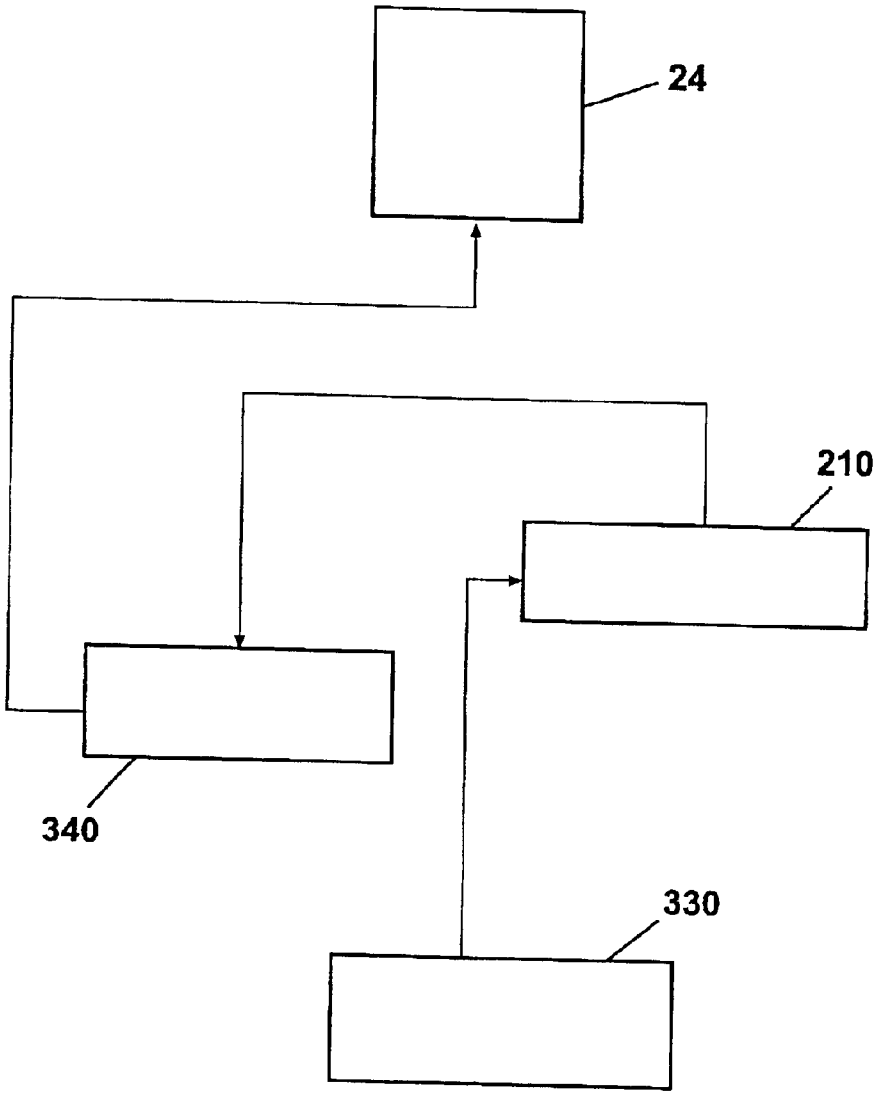
FIG. 10 is a block diagram of a seventh embodiment of an upright vacuum cleaner with cyclone according to the invention.

A block diagram of a seventh embodiment of a vacuum cleaner with cyclone separator is shown in FIG. 10. A suction nozzle 330, typically formed in the base module 14 of the vacuum cleaner 10, is fluidly connected with the inlet of cyclone separator 210 according to any of its disclosed embodiments. The outlet of the cyclone separator 210 is fluidly connected with the inlet of a suction source 340, which can typically be housed in the base module 14 or lower end 16 of handle assembly 12 (see FIG. 1). The outlet of suction source 340 is fluidly connected with the inlet of collection bag 24. Upon activation of suction source 340, a working airflow is generated from suction nozzle 330, through cyclone separator 210 where a portion of dirt and debris entrained in the airflow is deposited. The working airflow then passes through the suction source 340 to collection bag 24, where dirt remaining in the airflow can be collected. The collection bag 24 is sufficiently permeable to allow the airflow to pass therethrough while dirt is removed from the airflow.

As described in the above seven embodiments, since the dirt and debris contained in the dirty airflow are primarily collected by the cyclone separator, the present invention can remarkably reduce the quantity of the dirt collected at the collection bag 24 or filter medium 320 of the cleaner 10. Therefore, it is possible to extend the period for replacing or servicing the collection bag 24 or filter medium 320.

In addition, when the dirt-collecting tub 230 of the cyclone separator is filled with dirt, the dirt can be removed by simply separating the dirt-collecting tub 230 from the cyclone body 220 without removing the cyclone separator 210 from the cleaner 10.

While particular embodiments of the invention have been shown, it will be understood that the invention is not limited thereto. Reasonable variation and modification are possible within the scope of the foregoing disclosure and drawings, particularly in light of the foregoing teachings, without departing from the spirit of the invention which is defined in the appended claims.

What is claimed is:

1. An upright vacuum cleaner having a base module and a handle pivotally mounted thereto for pivotal movement about a pivot axis between an upright stored position and a reclining use position;

the base module having a suction nozzle at a forward portion thereof;

at least one pair of wheels supporting the base for movement along a surface to be cleaned;

a filter bag mounted to the handle for recovering dirt from dirty air;

a suction source mounted to one of the handle and the base;

a working air conduit comprising a portion of the handle; and a cyclonic dust separator comprising:

a cyclone body having an inlet opening and an outlet opening each connected to the working air conduit, the inlet opening being connected to the working air conduit in an upstream direction from the outlet opening, the cyclone body adapted to produce a cyclonic air current for separating dirt contained in working air entering the cyclone body through the inlet opening;

a cylindrical dirt-separating grille within said cyclonic dust separator between the inlet opening and outlet opening and having a plurality of holes through which working air passes between the inlet opening and outlet openings of the cyclone body;

a dirt-collecting tub removably mounted to the cyclone body for collecting dirt separated from the working air by the cyclonic air current of the cyclone body; and an annular baffle plate mounted to a bottom portion of the dirt-separating grille and extending laterally thereof.

2. An upright vacuum cleaner having a base module and a handle pivotally mounted thereto for pivotal movement about a pivot axis between an upright stored position and a reclining use position;

the base module having a suction nozzle at a forward portion thereof;

at least one pair of wheels supporting the base for movement along a surface to be cleaned;

a working air conduit comprising a portion of the handle;

a cyclone dust separator;

a post-cyclone filter assembly in the form of a soft porous bag enclosing a filter bag that is in fluid communication with the working air conduit; and a suction source mounted to one of the handle and the base, the suction source has an inlet fluidly connected to the suction nozzle and an outlet fluidly connected to the cyclone dust separator for drawing working air from the suction nozzle, and moving the working air through the working air conduit and the cyclone dust separator to is the filter bag.

3. An upright vacuum cleaner having a base module and a handle pivotally mounted thereto for pivotal movement about a pivot axis between an upright stored position and a reclining use position;

the base module having a suction nozzle;

a filter bag removably mounted to the handle for movement therewith;

a working air conduit between the suction nozzle and the filter bag;

a suction source mounted to one of a lower portion of the handle and the base module and in communication with the suction nozzle and the filter bag for moving dust-laden air between the suction nozzle and through the filter bag; and a cyclonic dust separator mounted in the working air conduit upstream of the filter bag for separating larger particles from the dust-laden air before the dust-laden air passes through the filter bag;

wherein the handle includes a rigid elongated tube that extends between the base module at a lower end and the filter bag at an upper end, the cyclonic dust separator is mounted to the rigid elongated tube, and the filter bag is mounted at an upper portion to the elongated tube for recovering dirt from dirty air and extends downwardly therefrom along at least a portion of the elongated tube.

4. The vacuum cleaner of claim 3 wherein the cyclonic dust separator includes:

a cyclone body having an inlet opening and an outlet opening, at least the inlet opening is connected to the rigid elongated tube upstream from the outlet opening, the cyclone body adapted to produce a cyclonic air current for separating dirt contained in working air entering the cyclone body through the inlet opening; and a dirt-collecting tub removably mounted to the cyclone body for collecting dirt separated from the dust-laden air by the cyclonic air current of the cyclone body;

wherein the cyclonic dust separator separates larger dust particles and debris from the dust-laden air before the dust-laden air is filtered by the bag filter.

5. The vacuum cleaner of claim 4 wherein the cyclone body further comprises a dirt-separating grille having a plurality of holes between said inlet and outlet openings.

6. The vacuum cleaner of claim 5 wherein the dirt-separating grille is cylindrical and is axially positioned in the dirt-collecting tub.

7. The vacuum cleaner of claim 6 and further comprising an annular baffle plate mounted to a bottom portion of the dirt-separating grille and extending laterally thereof.

8. The vacuum cleaner of claim 7 wherein the annular baffle plate is frusto-conical in shape.

9. The vacuum cleaner of claim 7 and further comprising at least one latch for removably suspending the dirt-collecting tub from the cyclone body.

10. The vacuum cleaner of claim 4 and further comprising at least one latch for removably suspending the dirt-collecting tub from the cyclone body.

11. The vacuum cleaner of claim 4 wherein the outlet opening is also connected to the rigid elongated tube and the cyclonic separator is connected to the rigid elongated tube intermediate the ends thereof.

12. The vacuum cleaner of claim 3 wherein suction source is mounted in the working air conduit downstream of the filter bag.

13. The vacuum cleaner of claim 3 wherein the filter bag is a conventional bag filter and is mounted in a bag filter housing that is mounted to the handle.

14. An upright vacuum cleaner having a base module and a handle pivotally mounted thereto for pivotal movement about a pivot axis between an upright stored position and a reclining use position;

the base module having a suction nozzle;

a filter bag removably mounted to the handle for movement therewith;

a working air conduit between the suction nozzle and the filter bag;

a suction source mounted to one of a lower portion of the handle and the base module and in communication with the suction nozzle and the filter bag for moving dust-laden air between the suction nozzle and through the filter bag; and a cyclonic dust separator mounted in the working air conduit upstream of the filter bag for separating larger particles from the dust-laden air before the dust-laden air passes through the filter bag;

wherein the suction source is mounted in the working air conduit between the suction nozzle and the cyclonic dust separator.

15. An upright vacuum cleaner having a base module and a handle pivotally mounted thereto for pivotal movement about a pivot axis between an upright stored position and a reclining use position;

the base nodule having a suction nozzle;

a filter bag removably mounted to the handle for movement therewith;

a working air conduit between the suction nozzle and the filter bag;

a suction source mounted to one of a lower portion of the handle and the base module and in communication with the suction nozzle and the filter bag for moving dust-laden air between the suction nozzle and through the filter bag; and a cyclonic dust separator mounted in the working air conduit upstream of the filter bag for separating larger particles from the dust-laden air before the dust-laden air passes through the filter bag;

wherein the suction source is mounted in the working air conduit between the cyclonic dust separator and the filter bag.

* * * * *